United States Patent [19]

Genereaux

[11] Patent Number: 4,699,437

[45] Date of Patent: Oct. 13, 1987

[54] APPARATUS FOR STORING OBJECTS

[76] Inventor: Eugene P. Genereaux, 7837 S. Forest St., Littleton, Colo. 80122

[21] Appl. No.: 733,938

[22] Filed: May 14, 1985

[51] Int. Cl.[4] ..... A47F 5/08

[52] U.S. Cl. ..... 312/248; 52/39; 220/85 H; 248/202.1; 312/246; 312/251

[58] Field of Search ..... 312/246, 247, 248, 250, 312/253, 243, 251, 245; 220/18, 85 H; 52/32, 36, 39; 248/201, 342, 202.1

[56] References Cited

U.S. PATENT DOCUMENTS

| | | | |
|---|---|---|---|
| 119,962 | 10/1871 | Breed . | |
| 470,037 | 3/1892 | Cary | 312/248 X |
| 735,946 | 8/1903 | Coleman et al. | 248/201 X |
| 759,769 | 5/1904 | Tandy . | |
| 1,819,516 | 8/1931 | Kelly | 312/247 X |
| 2,565,845 | 8/1951 | Frederick . | |
| 2,648,516 | 8/1953 | Manetti et al. | 312/248 X |
| 3,331,645 | 7/1967 | Vercellotti | 312/248 |
| 3,464,749 | 9/1969 | Bishop . | |
| 3,485,544 | 12/1969 | Beckerman . | |
| 3,537,769 | 11/1970 | Carlo | 312/250 |
| 3,593,470 | 7/1971 | Francis | 52/36 |
| 3,627,397 | 12/1971 | Rominsky | 312/246 |
| 3,627,398 | 12/1971 | Reese . | |
| 3,721,484 | 3/1973 | Macioge et al. . | |
| 4,026,434 | 5/1977 | Howard . | |
| 4,076,351 | 2/1978 | Wyant . | |
| 4,285,557 | 8/1981 | Paladino et al. | 312/248 X |
| 4,446,660 | 5/1984 | Miller et al. | 52/39 X |
| 4,592,604 | 6/1986 | Wilke | 312/245 |

FOREIGN PATENT DOCUMENTS

| | | | |
|---|---|---|---|
| 2459639 | 2/1981 | France | 312/250 |
| 2042620A | 9/1980 | United Kingdom | 248/201 |

*Primary Examiner*—Kenneth J. Dorner
*Assistant Examiner*—Thomas A. Rendos
*Attorney, Agent, or Firm*—Klaas & Law

[57] ABSTRACT

A container having a transparent base is pivotally mounted between the spaced apart rafters in a ceiling so that the container can be maintained in a first relatively fixed position, moved to a second position supported by the pivot mounting so that objects may be placed into or removed from the container or completely removed to be transported to any desired location.

6 Claims, 7 Drawing Figures

APPARATUS FOR STORING OBJECTS

FIELD OF THE INVENTION

This invention relates generally to the storing of objects which storage can be on a relatively permanent basis, a semi-permanent basis or a regular use bases and in particular to the storing of objects in areas which are not normally used for any purpose but wherein such storage is readily accessible so that the objects may be readily placed into or taken out of storage.

BACKGROUND OF THE INVENTION

One problem that seems to be ever before a household is finding storage places for the many objects that have been accumulated over the years, that are seasonal, that are used regularly or that are present for any other reason. As a result of this need, most households have shelves built wherever possible, have put flooring in attics or garages and have made other such efforts in an attempt to gain additional storage space. The term households is meant to include structures other than only houses, such as recreational vehicles, boats or other similar equipment. Even with all these various strategies, there continues to exist a pressing need for more storage space.

BRIEF DESCRIPTION OF THE INVENTION

This invention provides apparatus for storing objects in areas that have not been normally used for any particular purpose such as between the joists, rafters or any other structure functioning in a similar manner in a garage, basement, crawl space and other similar places including those found in recreational vehicles and boats types of locations. In a preferred embodiment of the invention, a container having a transparent base with four sidewalls is provided. Means are provided for holding the container in a first relatively fixed position or for permitting movement of the container to a second position, while still supporting the container, so that objects may be placed into or removed from the container or for permitting complete removal of the container so that it may be transported to a different location. This provides a clean, safe, dry and accessible means for the storage of many types of objects that are used on a seasonal or regular basis. Also, hazardous materials may be stored out of the reach of children and protected against accidental spillage.

In a preferred embodiment of the invention, the container is provided with four rollers, two of which are mounted at spaced locations on the outer surface of a pair of opposed side walls of the container. A cooperating pair of bearing surfaces are mounted at spaced locations on each of the facing sides of a pair of adjacent joists or rafters to provide opposed pairs of tracks each of which has a recessed portion for receiving one of the rollers. Each track of one pair of opposed tracks comprises a bottom section and two end sections so as to limit the movement of the rollers in each direction. Each end section has a projection extending toward each other and terminating a distance apart so as to leave a space so that a roller can pass therethrough. Each track of a second pair of opposed tracks comprises a bottom section having an inclined bearing surface terminating in an end wall to limit movement of the roller and open access is provided to the bearing surface so that a roller may be placed thereon. In the first relatively fixed position, a roller is in each track of the one pair of opposed tracks adjacent to one end section and a roller is in each track of the second pair of opposed tracks adjacent to the end wall. When it is desired to move the container to the second position, the container is moved over the bearing surfaces until the rollers move off the bearing surfaces of the second pair of opposed tracks. At that time, each roller in the one pair of opposed tracks will be adjacent the other end section. The container may then be pivoted about the rollers to a second position supported by the rollers on the bearing surfaces of the one pair of opposed tracks so that objects may be removed from or placed into the container. If it is desired to transport the container to another location, the rollers are moved through the space between the projections on each of the one pair of opposed tracks so that the container may be completely removed and transported as desired.

It is an object of this invention to provide apparatus for storing objects in normally unused areas.

It is another object of this invention to provide apparatus for storing objects in normally unused areas in a manner so that the stored objects are readily visible.

It is a further object of this invention to provide apparatus for storing objects in normally unused areas in a container and to provide means so that the container may be held in a first relatively fixed position, may be readily moved to a second supported position where objects may be placed into or removed from the container or may be completely removed and transported to different a location.

It is yet a further object of this invention to provide apparatus for storing objects in normally unused areas in a manner so that the objects will remain in one relative position on the apparatus during movement into or out of the normally unused areas.

Additional objects, advantages, and novel features of the invention are set forth in part in the description which follows which will be understood by those skilled in the art upon examination of the following or may be learned by practice of the invention. The objects and advantages of the invention may be realized and obtained by means of the instrumentalities and combinations particularly pointed out in the appended claims.

DETAILED DESCRIPTION OF THE INVENTION

Figure 1:
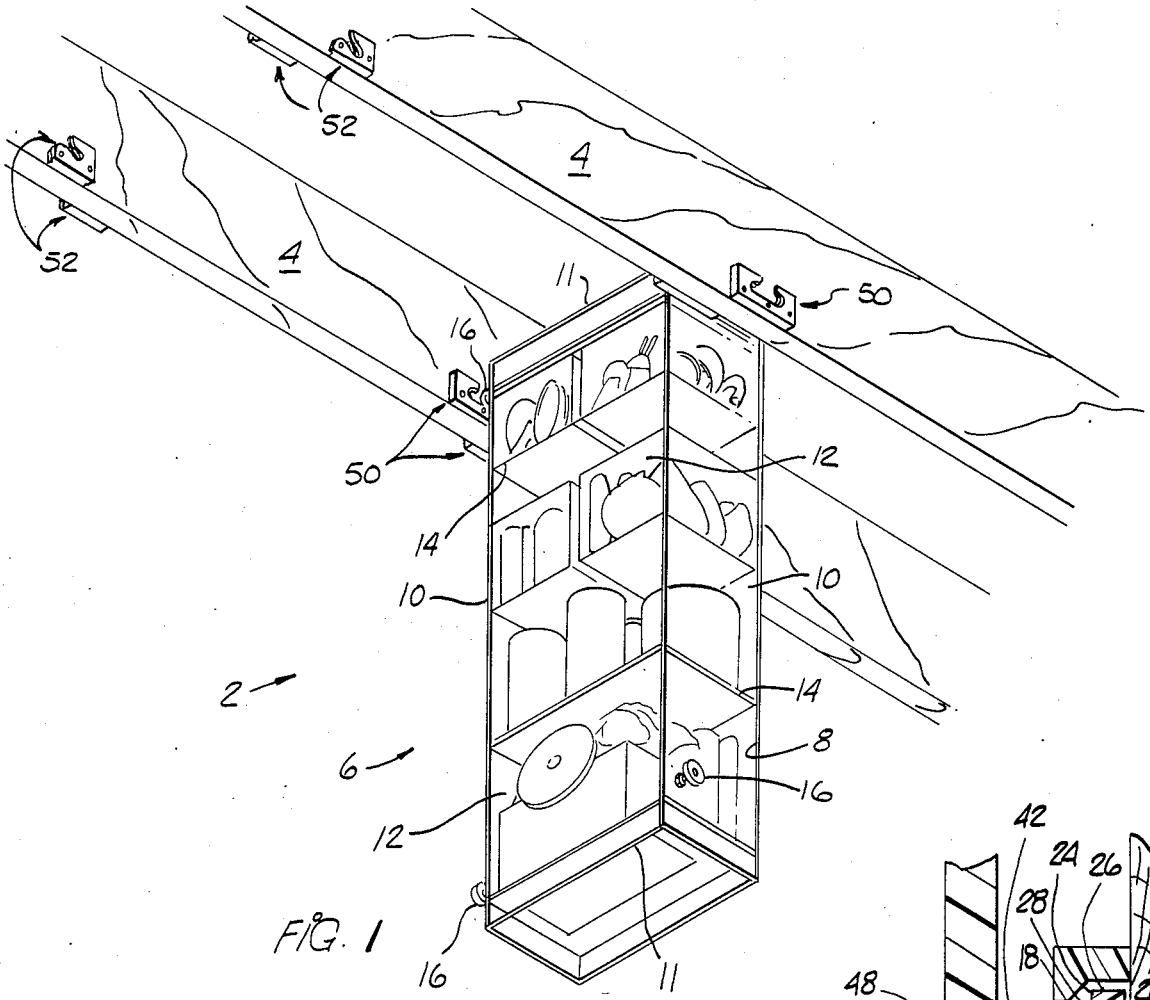
FIG. 1 is a pictorial view of an apparatus of this invention.

In FIG. 1, there is illustrated one of the preferred embodiments of apparatus 2 for storing objects in a normally unused area, such as between the rafters 4. The term rafters includes any similar structure which cooperates to form an empty space therebetween. The apparatus 2 comprises a container 6 having a base 8, side walls 10 and end walls 11 which is divided into a plurality of compartments 12 by appropriate panels 14. The container 6, illustrated in FIG. 1, is preferably integrally molded from a transparent material so that objects stored therein are readily visible. The panels 14 may be secured as desired to the container 6 so as to provide compartments 12 of any desired size. The container 6 could also be formed using wooden side walls 10 and a transparent base 8. If desired, the container could be formed completely from metal. This latter construction could serve as a safe since the space between the floor joists in a basement or a crawl space is one of the last places to burn in the event of a fire. This is particularly so in an area adjacent to a wall and in a corner. If desired, a lid can be used to cover any open area of the container and would be particularly useful when used as a safe so that the objects could be locked therein.

Figure 2:
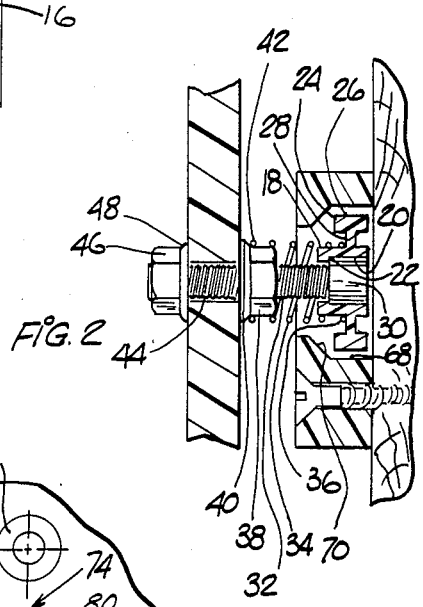
FIG. 2 is a view with parts in section of a roller mounting means.

The container 6 is provided with four rollers 16 which are secured at spaced apart locations with two rollers 16 on the outer surface of each sidewall 10. An enlarged view of the structure associated with each roller 16 is illustrated in FIG. 2. Each roller 16 comprises a central section 18 having a central opening 20 having portions of different diameters so as to form a shoulder 22. A rim portion 24 having an annular surface 26 projects outwardly from the central section 18 and an annular recess 28 is provided in the rim portion 24. A bearing 30 attached to a threaded shank 32 is positioned into the opening 20 until the bearing 30 contacts the shoulder 22. A coiled spring 34 is then positioned around the threaded shank 32 with one end 36 of the coiled spring 34 seated in the annular recess 28. A nut 38 is threaded onto the threaded shank 32 and has an annular rim 40 of sufficient diameter to contact the other end 42 of the coiled spring 34. The nut 38 is moved over the threaded shank 32 until the coiled spring has been compressed a sufficient amount so as to exert the force required to urge the roller outwardly to a desired position. The end of the threaded shank 32 is then moved through an opening 44 in the sidewall 10 and a nut 46 having an enlarged rim 48 is threaded onto the threaded shank 32. The nut 46 is tightened until the rims 40 and 48 are in snug engagement with the surfaces of the side wall 10 surrounding the opening 44. This mounting of the rollers 16 provides for slight variations in rafter spacing as described below.

A first pair of bearing surfaces comprising opposed tracks 50 and a second pair of bearing surfaces comprising opposed tracks 52 are mounted on the facing surfaces of the rafters 4. Each of the tracks 50 comprises a generally linearly extending bottom section 54, two end sections 56 and 58 and two projecting portions 60 and 62 having ends which are spaced apart so as to provide an opening 64. The bottom section has a recessed portion 66 which provides a bearing surface 68 for supporting roller a 16. The recessed portion 66 extends into the end sections 56 and 58 and the projecting portions 60 and 62 to provide a space for the rim portion 24 of the roller 16. A tapered sidewall 70 extends from the bearing surface 68 to ensure that a roller 16 is guided onto the bearing surface 68.

Each of the tracks 52 comprises a bottom section 72 having a recessed portion 74 that provides a bearing surface 76 which is inclined to the horizontal. An end wall 78 is provided to limit movement of a roller 16 placed on the bearing surface 76. A tapered side wall 80 extends from the bearing surface 76 to ensure that a roller 16 is guided onto the bearing surface 76.

Figure 3:
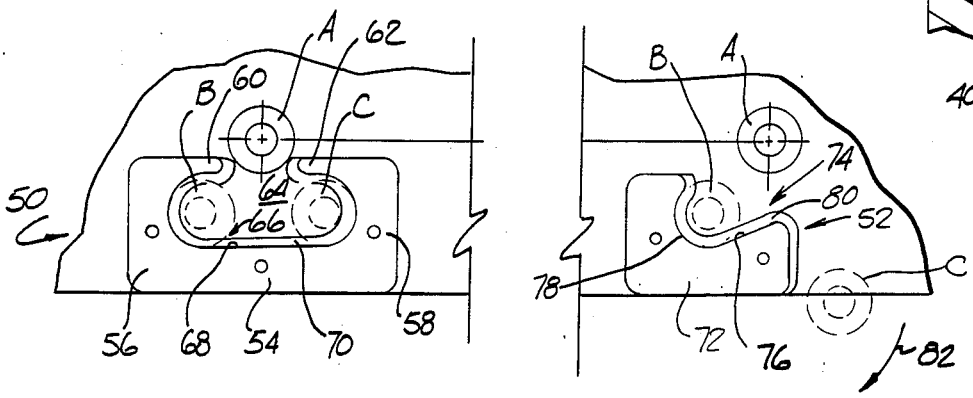
FIG. 3 is a schematic illustration of the location of the rollers in different positions of the container.
Figure 5:
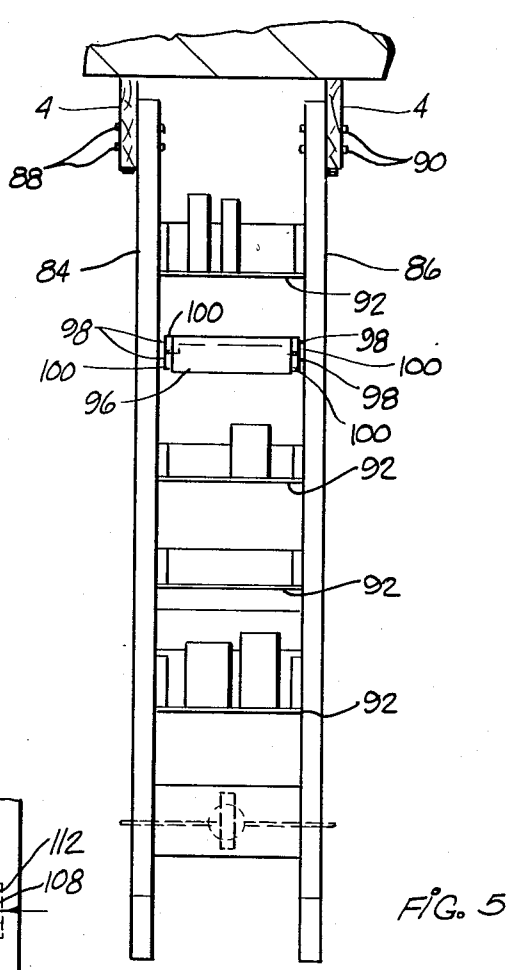
FIG. 5 is a front view of FIG. 4.

The location of the rollers 16 relative to the tracks 50 and 52 at various times during the use of the apparatus of this invention is illustrated in FIG. 3. When the rollers 16 are in position A, the container 6 is in a position to be placed onto the tracks 50 and 52 or to be completely removed for transportation to a different location. When the rollers 16 are in position B, the container 76 is in the first relatively fixed position. The roller 16 on the bearing surface 76 of the track 52 has responded to the force of gravity and moved to a position adjacent to the end wall 78. This has caused the roller 16 to move over the bearing surface 68 of the track 50 to a position adjacent to the end section 56. When the rollers 16 are in position C, the container 6 is being moved to a second position so that objects may be placed into or removed from the container 6. It is noted that the roller 16 is still supported by the bearing surface 68 of the track 50 and has moved to a position adjacent to the end section 58. The roller 16 has been moved off the bearing surface 76 of the track 52 and is moving downwardly in an arcuate path as illustrated by the arrow 82. If desired, means can be provided to limit movement of the container 6 in the direction of the arrow 82 in an amount slightly less than 90 degrees.

In operation, a container 6 is positioned so that a plurality of objects may be placed therein. The container 6 is then moved to position A illustrated in FIG. 3 and then lowered so that rollers 16 contact the bearing surfaces 68 and 76. The inclined bearing surface 76 causes the roller 16 to move to a position adjacent to the end wall 78 and the roller 16 to move over the bearing surface 68 to a position adjacent to the end section 56. The tapered side walls 70 and 80 guide the rollers 16 into proper position on the bearing surfaces 68 and 76 and the coil springs 34 allow the roller 16 to move in or out to allow for slight variations in the spacing between the rafters 4. When it is desired to place additional objects into the container 6 or to remove objects therefrom, the container 6 is moved over the bearing surfaces 68 and 76 until the rollers 16 have moved off the bearing surfaces 76. The container 6 is then pivoted around the rollers 16 on the bearing surface 68 to a position wherein the objects in the container 6 can be grasped. Although only one container 6 is illustrated in FIG. 1, it is understood that a plurality of containers are to be positioned between rafters 4. In FIG. 1, there are illustrated other tracks 50 and 52 for this purpose. Since at least the base 8 of each container 6 is transparent, the objects stored in each container 6 may be readily identified so that the proper container 6 may be readily located when it is desired to place additional objects into or remove objects from a container 6.

In the apparatus illustrated in FIGS. 1–3, the rafters 4 extend in a relative horizontal direction. In those instances where the rafters are inclined to the horizontal or extend vertically as in side wall, the opposed tracks 52 are mounted so that the opening therein faces the cooperating opposed track 50. This permits the force of gravity to ensure the position of the roller 16 against the end wall 78. Also, if it is desired to store objects beneath a finished ceiling or any other location, suitable means may be provided to support the opposed tracks 50 and 52 at proper locations to cooperate with the rollers 16 on the container 6.

Figure 4:
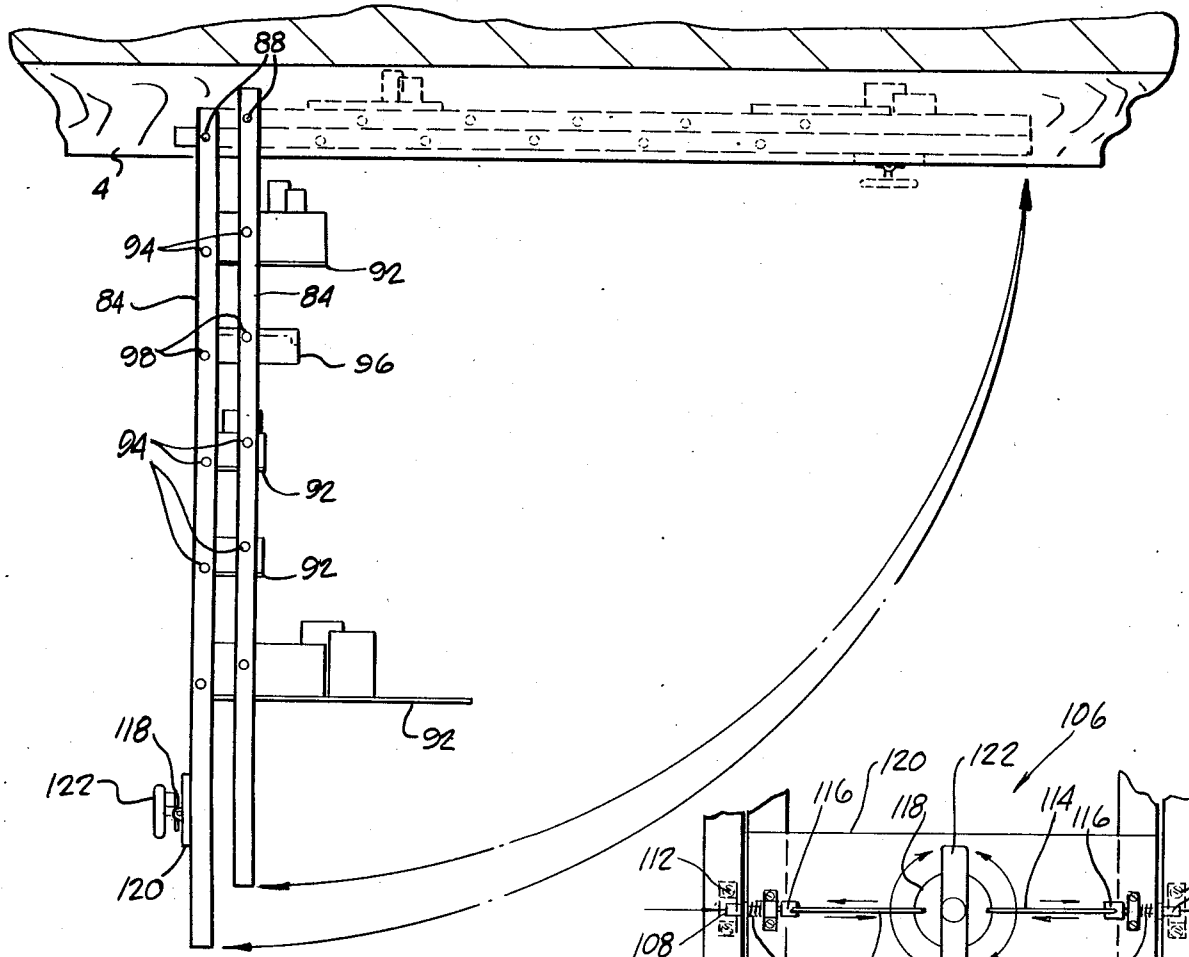
FIG. 4 is a side view of a modification of the invention.

A modification of the apparatus 2 used for storing objects is illustrated in FIGS. 4–7. Two pairs of opposed arms 84 and 86 are mounted by conventional pivot means 88 and 90 on the rafters 4. The arms 84 and 86 are preferably formed from wood but can be formed from any material capable of supporting the weight of the objects stored. A plurality of spaced apart supporting surfaces 92 are mounted by conventional pivot means 94 to the opposed pairs of arms 84 and 86. The pivotal mounting of the pairs of arms 84 and 86 and the supporting surfaces 92 causes the apparatus to move so that objects stored on the supporting surfaces 92 remain in parallel planes as the arms 84 and 86 move. As illustrated in FIG. 4, each supporting surface 92 is generally horizontal both in the lowered position and in the stored position.

Figure 7:
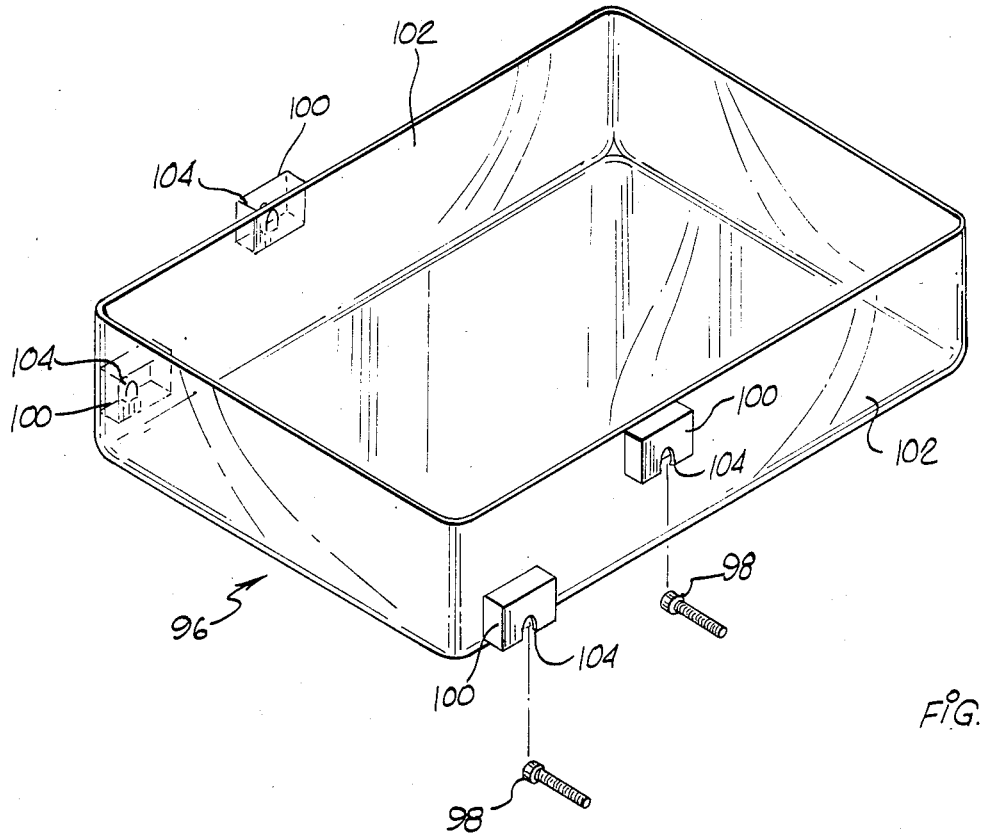
FIG. 7 is a pictorial view of a container for use with the modification of FIG. 4.

A preferred supporting surface 92 is illustrated in FIG. 7 and comprises an integrally molded transparent container 96. Two bearings 98 having threaded shanks are secured in the proper position on the arms 84 and 86. A pair of blocks 100 are secured to the outer surfaces 102 of the container 96. Each block 100 has a recess 104 shaped to receive one of the bearings 98 so as to provide a pivotal mounting of the container 96 on the arms 84 and 86.

Figure 6:
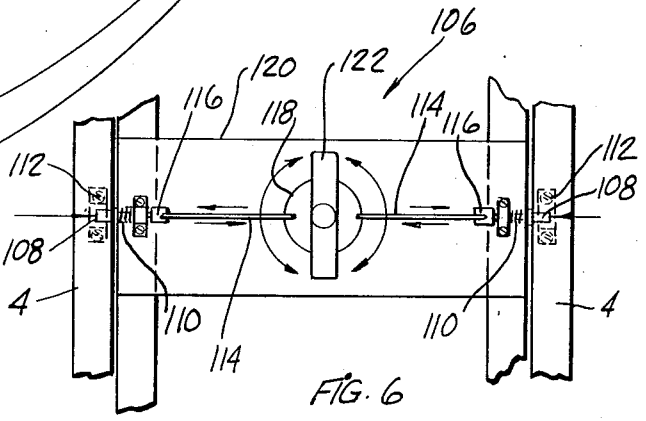
FIG. 6 is a plan view of the locking means for the modification of FIG. 4.

A locking means 106 is illustrated in FIG. 6 and comprises locking pins 108 which are normally urged outwardly by springs 110 to a location in latches 112 mounted on the bottom surfaoe of the rafters 4. The means for moving the locking pins 108 so that the arms 84 and 86 may be moved downwardly comprises rods 114 which are pivotally mounted to the ends 116 of the locking pins 108 and to a central plate 118 which is rotatably mounted on the support member 120. A handle 122 is provided to facilitate the rotation of the central plate 118. As illustrated in FIG. 6 rotation of the handle 122 in either direction causes movement of the rods 114 so as to move the locking pins 108 against the force of the springs 110. When the handle 122 is released, the locking pins 106 will be moved outwardly by the force exerted by the springs 110.

It is contemplated that the inventive concepts herein described may be variously otherwise embodied and it is intended that the appended claims be construed to include alternative embodiments of the invention except insofar as limited by the prior art.

What is claimed is:

1. Apparatus for storing objects comprising:

a container for holding objects, said container having a predetermined overall volume;

a pair of spaced apart members secured to a surface to provide an open ended cavity facing downwardly from the horizontal at least slightly greater in volume than said predetermined volume of said container;

said pair of spaced apart members having facing surfaces;

at least four bearing surfaces permanently secured to said facing surfaces with a first pair of said bearing surfaces located directly opposite each other and a second pair of bearing surfaces located directly opposite each other, said second pair of bearing surfaces having a structural configuration which is dissimilar to the structural configuration of said first pair of bearing surfaces;

at least four bearings permanently secured to said container so that a first pair of said bearings are in mating relationship with said first pair of bearing surfaces and a second pair of bearings are in mating relationship with said second pair of bearing surfaces;

said at least four bearing surfaces having holding means cooperating with said at least four bearings to hold said container in a first relatively fixed position between said members;

said holding means of said first pair of bearing surfaces having means defining an end wall at each end of said bearing surfaces and an opening facing in an upward direction from the horizontal and readily cooperating with said first pair of bearings to permit movement of said container out of said holding means of said first pair of bearing surfaces to a second supported position wherein said holding means of said second pair of bearing surfaces hold and support said second pair of bearings so that objects may be placed into or removed from said container;

said holding means of said second pair of bearing surfaces having means defining an end wall at each end of said bearing surfaces and an opening facing in an upward direction from the horizontal readily cooperating with said second pair of bearings to permit complete removal of said container from said bearing surfaces;

said at least four bearing surfaces remaining secured to said facing surfaces after said complete removal of said container; and said at least four bearings remaining secured to said container after complete removal of said container.

2. Apparatus as in claim 1 wherein said container comprises:

a base; and at least four side walls secured to said base.

3. Apparatus as in claim 1 wherein:

one of said end walls of said holding means for said first pair of bearing surfaces comprises an inclined surface extending upwardly from the horizontal.

4. Apparatus for storing objects comprising:

a container having a base and at least four side walls secured to said base for holding objects;

means for holding said container in a first relatively fixed position; for permitting movement of said container to a second supported position wherein objects may be placed into or removed from said container; and for permitting complete removal of said container from either said first or second position;

said means comprising at least four bearings and at least four bearing surfaces so that said bearings can be moved over and supported by said bearing surfaces;

said at least four bearings comprise rollers, two of which are secured to the outer surface of each of an opposed pair of said side walls;

said at least four bearing surfaces comprise opposed tracks, each of said tracks having a recessed portion for receiving at least a portion of one of said rollers; said opposed tracks comprising:

at least one pair of opposed tracks each of which has a generally linear bottom section, an end section on each end of said bottom section for limiting movement of one of said rollers on said bearing surface and a generally linear projection from each end section to form a top section having an opening of sufficient size to allow for passage of one of said rollers therethrough;

at least another pair of opposed tracks each of which has a bottom section having an inclined bearing surface and an end wall to limit movement of one of said four rollers placed on said bearing surface;

each of said tracks having a tapered side wall for ensuring free movement of said rollers over said bearing surfaces; and spring means for mounting said rollers for ensuring tolerance adjustment for said rollers.

5. Apparatus as in claim 4 and further comprising:

a pair of opposed longitudinally extending overhead support members, each of said overhead support members having a generally rectangular cross-sectional configuration; and means for securing said opposed tracks to said overhead support members.

6. Apparatus as in claim 4 wherein:

said base is substantially horizontal when in said first relatively fixed position; and said inclined bearing surfaces urge two of said rollers to positions against said two end walls.

* * * * *